US010232201B2

(12) United States Patent
Wells et al.

(10) Patent No.: US 10,232,201 B2
(45) Date of Patent: Mar. 19, 2019

(54) FALL ARREST APPARATUS

(71) Applicant: Capital Safety Group (Northern Europe) Limited, Redditch, Worcestershire (GB)

(72) Inventors: Marie Wells, Warwick (GB); Robert Hirst, Stourbridge (GB)

(73) Assignee: Capital Safety Group (Northern Europe) Limited, Bracknell, Berkshire (GB)

( * ) Notice: Subject to any disclaimer, the term of this patent is extended or adjusted under 35 U.S.C. 154(b) by 0 days.

(21) Appl. No.: 15/030,493

(22) PCT Filed: Oct. 20, 2014

(86) PCT No.: PCT/EP2014/072409

§ 371 (c)(1),
(2) Date: Apr. 19, 2016

(87) PCT Pub. No.: WO2015/059080

PCT Pub. Date: Apr. 30, 2015

(65) Prior Publication Data

US 2016/0243384 A1 Aug. 25, 2016

(30) Foreign Application Priority Data

Oct. 21, 2013 (GB) ..... 1318522.8

(51) Int. Cl.
*A62B 35/04* (2006.01)
*A62B 35/00* (2006.01)

(52) U.S. Cl.
CPC ..... *A62B 35/04* (2013.01); *A62B 35/0068* (2013.01)

(58) Field of Classification Search
CPC ..... A62B 35/04; A62B 35/0068
See application file for complete search history.

(56) References Cited

U.S. PATENT DOCUMENTS 3,106,989 A * 10/1963 Fuchs ..... B60R 22/28 188/375
5,738,377 A * 4/1998 Sugiki ..... B62D 1/195 188/376
6,098,746 A * 8/2000 Castaneda ..... A62B 35/0043 182/45
6,279,680 B1 * 8/2001 Casebolt ..... A62B 35/0087 182/18
6,394,241 B1 * 5/2002 Desjardins ..... F16F 7/12 188/371
6,412,598 B1 * 7/2002 Mackinnon ..... E04G 21/3261 182/113

(Continued)

FOREIGN PATENT DOCUMENTS

GB 2396195 A 6/2004
WO WO 00-24470 A1 5/2000

(Continued)

*Primary Examiner* — Katherine W Mitchell
*Assistant Examiner* — Candace L Bradford

(57) ABSTRACT

A fall arrest apparatus comprises a rod (5) adapted at a first end region thereof to be attached to a structure (3), and an energy absorber (11) attached to a second end region of the rod. The energy absorber includes an attachment point (33) for further fall arrest means and an energy absorbing rip zone (41) which tears to absorb energy when subject to a force in excess of a threshold.

17 Claims, 3 Drawing Sheets

(56) References Cited

U.S. PATENT DOCUMENTS

| | | | | |
|---|---|---|---|---|
| 7,658,444 | B2 * | 2/2010 | Murphy | B60N 2/2809 297/216.11 |
| 8,104,841 | B2 * | 1/2012 | Malapati | B60N 2/2809 296/35.2 |
| 2004/0145098 | A1 * | 7/2004 | Thaler | A62B 35/04 267/33 |
| 2007/0205063 | A1 * | 9/2007 | De Frenne | F16F 9/512 188/266.2 |
| 2009/0133977 | A1 * | 5/2009 | Warren | A62B 35/04 188/371 |
| 2009/0194366 | A1 * | 8/2009 | Parker | A62B 35/04 182/3 |
| 2009/0277719 | A1 * | 11/2009 | Clough | A62B 35/04 182/5 |
| 2010/0236867 | A1 * | 9/2010 | Jones | A62B 35/0093 182/231 |
| 2013/0118093 | A1 * | 5/2013 | Fortin | E04G 21/3276 52/27 |

FOREIGN PATENT DOCUMENTS

| | | | | |
|---|---|---|---|---|
| WO | WO 2012-177675 | A2 | 12/2012 | |
| WO | WO-2012177675 | A2 * | 12/2012 | A62B 35/04 |
| WO | WO-2015031063 | A1 * | 3/2015 | A62B 35/04 |

* cited by examiner

FALL ARREST APPARATUS

This invention relates to a fall arrest apparatus which may be used either as a single-point anchor or as an intermediate anchor in a fall arrest system. The fall arrest apparatus according to the present invention is more particularly, but not exclusively, intended for use with concrete structures, such as concrete roofs.

Fall arrest apparatus is employed to protect users against falls from height. Once connected to the fall arrest apparatus, the user is safe to work around a rooftop or other structure to a distance as far as an attachment lanyard allows. In the event of a fall, the fall arrest apparatus deploys to absorb the energy of the fall. Such fall arrest apparatus may be integrated into a fall arrest system including a number of individual fall arrest apparatus joined by a guide cable or guide wire.

The fall arrest apparatus conventionally employs a form of shock absorption to reduce the shock loading when a fall is arrested in order to reduce the risk of injury to the falling person and to minimise the forces applied to the components of the fall arrest apparatus and to the structure to which the apparatus is anchored.

A problem associated with conventional fall arrest apparatus lies in its complexity which can have an effect on both reliability and cost.

It is therefore an object of the present invention to provide a fall arrest apparatus which overcomes, or at least ameliorates, the above disadvantages.

According to the present invention there is provided a fall arrest apparatus comprising: a rod adapted at a first end region thereof to be attached to a structure; and an energy absorber attached to a second end region of the rod, the energy absorber including an attachment point for further fall arrest means and an energy absorbing rip zone which tears to absorb energy when subject to a force in excess of a threshold.

The second end region of the rod may be threaded to receive the rotational assembly. The rotational assembly may comprise a first nut threaded onto the second end region of the rod, a first washer adjacent to the first nut, a spacer adjacent to the first washer, a second washer adjacent to the spacer and a second nut adjacent to the second washer, the energy absorber being provided with an opening through which the spacer passes.

The first end region of the rod may be threaded for attachment to the structure.

The rod may be provided as a single length.

The rod may be provided with a weatherproof covering. The weatherproof covering may stop short of the second end of the rod and may be sealed to the rod in the second end region thereof.

The rod may include an indicator, such as a datum sleeve, which may be compressed onto the rod, to indicate the depth to which the rod is to be inserted into the structure. A washer may be provided to be positioned in use between the indicator and the structure.

The energy absorber may be secured to the second end region of the rod by way of a rotational assembly which allows the energy absorber to rotate about the axis of the rod.

The attachment point may provide means for attaching a karabiner to the energy absorber or may provide means for allowing a cable to pass through the attachment point.

The energy absorber may be made from a single plate of metal which is formed with the attachment point at one end region thereof, and a slit which defines the periphery of a connection to the rod, the ends of the slit leading to the energy absorbing rip zone.

The rip zone may include two (for example, parallel) lines of weakness which, when subject to the force in excess of the threshold, tear longitudinally to absorb energy. The two lines may each terminate in a relatively larger discontinuity (such as a terminal hole) than a transverse dimension of the line of weakness.

The lines of weakness may each be in the form of a row of discontinuities such as holes, recesses or slits extending in the direction of the respective row. The discontinuities of the first row may be offset in the longitudinal direction of the row relative to the discontinuities of the second row. Alternatively, the two rows of discontinuities may comprise two (for example, parallel) grooves.

The rip zone may have a curvature in the longitudinal direction thereof, which curvature may extend the length of the rip zone. Alternatively, the rip zone may be in the form of a coil. In further alternatives, the rip zone may be substantially coplanar with the connection to the rod, or the rip zone may be substantially perpendicular to the connection to the rod.

The connection to the rod may be deformed out of the plane of the remainder of the energy absorber. The attachment point may be deformed so as to extend substantially parallel to the connection.

For a better understanding of the present invention and to show more clearly how it may be carried into effect reference will now be made, by way of example, to the accompanying drawings in which.

Figure 1:
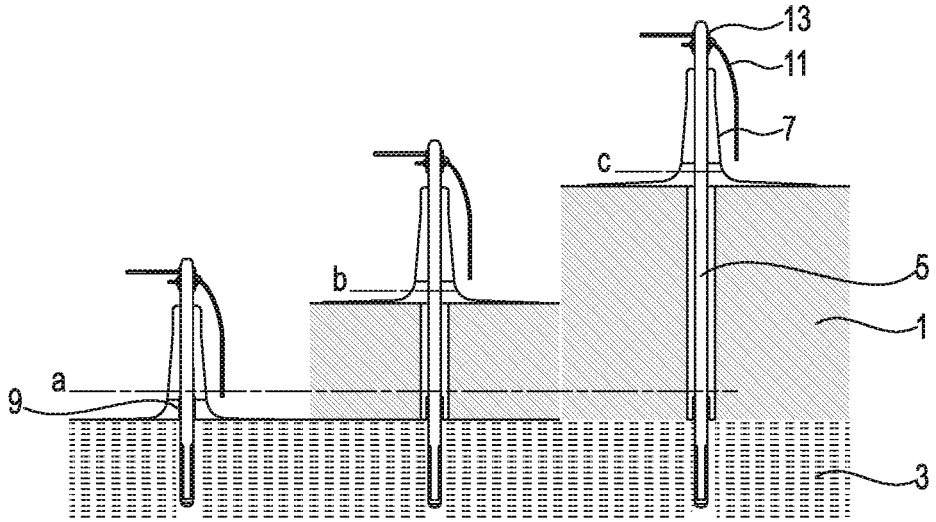
FIG. 1 is a side elevational view of one embodiment of a fall arrest apparatus according to the present invention, the apparatus being in first, second and third lengths.
Figure 2:
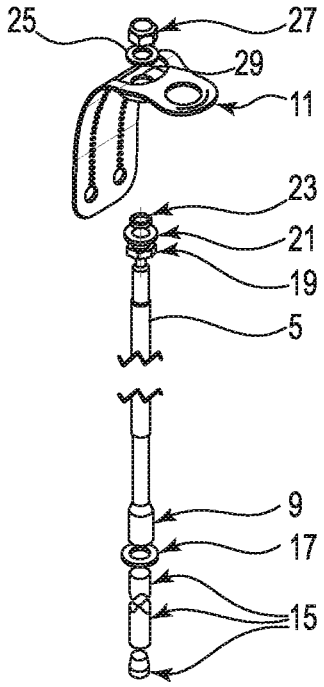
FIG. 2 is an exploded view of the fall arrest apparatus shown in FIG. 1.

FIGS. 1 and 2 show a fall arrest apparatus according to the present invention, with FIG. 1 showing the fall arrest apparatus in three different lengths. An apparatus having a first, relatively short, length is shown on the left-hand side of FIG. 1, an apparatus having a second, intermediate, length is shown in the middle of FIG. 1, and an apparatus having a third, relatively long, length is shown on the right-hand side of FIG. 1. The length of the apparatus is chosen in accordance with whether or not any insulation 1 is provided on a structure 3 such as a roof, for example of concrete, and, if so, how thick that insulation is. The left-hand version is used where there is no insulation, the middle version is used where there is, for example, up to 150 mm of insulation, while the right-hand version is used, for example, where there is up to 300 mm of insulation.

The fall arrest apparatus includes a rod 5 which passes through the insulation 1, where provided, and is securely inserted into the material of the structure 3 so as to remain in place even in the event of a fall by a user of the apparatus. This may be accomplished, for example, by providing a thread on a free end of the rod 5 and screwing the rod into a hole formed in the material of the structure. The rod is provided as a single length, for example of a suitable metal, in order to minimise the risk of fracture of the rod. The rod is provided with a weatherproof covering 7 and may include an indicator 9 to indicate the depth to which the rod is to be inserted into the material of the structure 3. The upper end of the weatherproof covering stops short of the top of the rod 5 and is sealed to the rod at the upper end of the covering 7. An energy absorber 11 is secured to the upper end of the rod 5 by way of a rotational assembly 13 which allows the absorber 11 to rotate about the axis of the rod. The rotational assembly 13 is shown in more detail in FIG. 2 and may be secured in place on the rod by way of a threaded portion formed on the rod and a nut provided on the threaded portion.

As shown more particularly in FIG. 2, a fixing assembly 15 is provided at the base of the rod 5. The fixing assembly 15 is conventional in itself and may include a threaded portion as previously mentioned. Indicator 9 may be in the form of a datum sleeve as shown in FIG. 2, the sleeve being compressed onto the rod 5 to provide a solid stop and set position for the fixing assembly, ensuring that the fixing assembly installs correctly rather than bottoming out in the hole in the structure in which the fixing is inserted. A washer 17 bears on the surface of the structure to prevent the indicator/datum sleeve 9 entering the fixing hole formed in the structure 3. The upper end of the rod 5 is threaded and receives the rotational assembly 13 which comprises a first (lower) hexagonal nut 19 with a first (lower) washer 21 being supported by the nut 19. A spacer 23 is supported on the first washer 21 and in turn supports a second (upper) washer 25, the assembly being completed by a second (upper) hexagonal nut 27, such as a NYLOC nut. The energy absorber 11 is formed with a circular opening 29 through which the spacer 23 passes, the spacer maintaining the washers 21 and 25 apart so as to permit free rotation of the energy absorber about the spacer 23.

Figure 3:
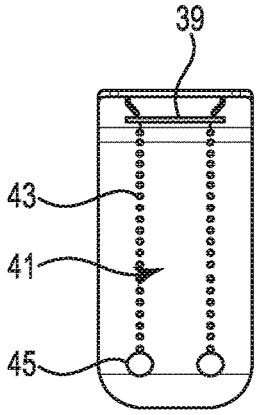
FIG. 3 is an end elevation of one embodiment of an energy absorber forming part of the fall arrest apparatus shown in FIGS. 1 and 2.
Figure 4:
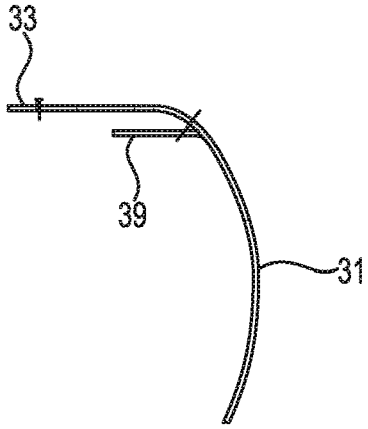
FIG. 4 is a side elevational view of the energy absorber shown in FIG. 3.
Figure 5:
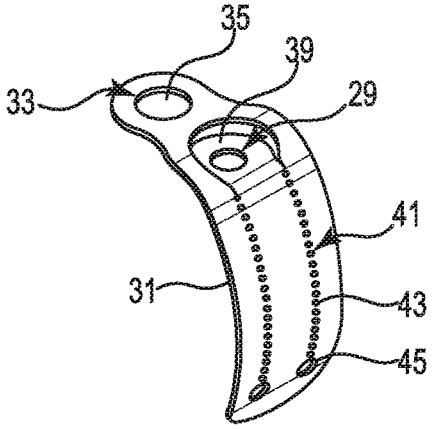
FIG. 5 is a perspective view of the energy absorber shown in FIGS. 3 and 4.
Figure 6:
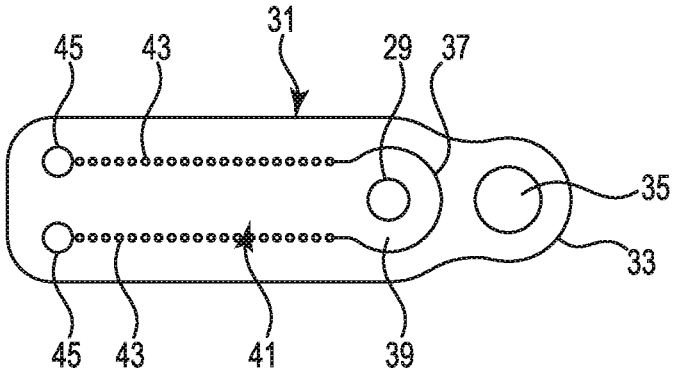
FIG. 6 is a plan view of a plate for the energy absorber shown in FIGS. 3 to 5 prior to forming into the energy absorber.

The energy absorber 11 is shown in more detail in FIGS. 3 to 6. As shown in FIG. 6, the energy absorber is made from a single plate 31 of metal which is formed at one end with an attachment point 33 for further fall arrest means such as a safety harness or the like (not shown), the attachment point having an aperture 35 to facilitate attachment of the safety harness. A slit 37, which in the illustrated embodiment is part-circular but may have alternative configurations such as polygonal or U-shape, defines the periphery of a connection 39 to the rod 5, the connection being provided with the circular opening 29 through which the spacer 23 of the fixing assembly 13 passes. The ends of the part-circular slit lead to an energy absorbing rip zone 41 which in the illustrated embodiment is in the form of two parallel rows of holes 43, each row being formed with a terminal hole 45 at the end of the row remote from the part-circular slit 37, the terminal hole 45 being of greater diameter than the holes 43. As illustrated, the holes 43 of one row are offset in the longitudinal direction of the rows relative to the holes of the other row. The plate may be made of stainless steel having a thickness of about 3 mm, an overall length of about 256 mm and a width of about 76 mm. The two rows of holes may be about 36 mm apart, the holes having a diameter of about 3 mm and a spacing in the region of 6 to 7 mm, the lower the spacing the lower the energy absorption capability of the energy absorber. The terminal holes may have a diameter of about 13 mm, the larger diameter having the effect of distributing stress more effectively than a smaller diameter hole. The length of the rip zone 41 is constrained by its configuration and by the length of the rod 5, the longer the rip zone the greater the capacity for energy absorption. As can be seen in FIGS. 4 and 5, the rip zone may have a curvature which may extend the available length thereof. Alternatively, the rip zone may be in the form of a coil in order to increase the length of the rip zone.

The dimensions of the energy absorber may be varied depending, for example, on the amount of energy to be absorbed.

As explained above, in the illustrated embodiment the rip zone 41 is formed by two rows of offset holes. However, the rip zone may take other forms. For example, the holes need not be offset in the two rows. Alternatively, the circular holes may be replaced by recesses or by slits extending in the direction of the respective row, which recesses or slits may or may not be offset. In a further alternative, the two rows of circular holes may be replaced by two parallel grooves. Essentially, the rip zone 41 provides two (for example, parallel) lines of weakness which, when subject to a force in excess of a threshold, tear longitudinally to absorb energy. The two lines each terminate in a relatively larger discontinuity (such as terminal hole 45) than a transverse dimension of the line of weakness to distribute force over a larger area than in the line of weakness itself.

As shown in particular in FIGS. 3, 4 and 5, the connection 39 to the rod 5 is deformed out of the plane of the plate 31 and the attachment point 33 is also deformed so as to extend substantially parallel to the connection 39. The rip zone 41 is formed with a curvature having a radius of about 140 mm, but this is largely aesthetic.

The offset between the plane of the connection 39 and the plane of the attachment point 33 is ideally as small as possible. However, if there is no offset it has been found that the apparatus exhibits a higher dynamic load than in the case that an offset is present. This is believed to be due to interaction between the connection 39 and the attachment point 33 and because the attachment point 33 is required to undergo greater deformation before the rip zone 41 is activated. The offset in the embodiment shown in FIGS. 3 to 5 is about 10 mm, but could be different (either larger or smaller).

The fall arrest apparatus shown in FIGS. 1 to 6 is installed on a structure 3, in particular the concrete roof of the structure, by forming a hole of suitable diameter and depth to accept the end of the rod 5 up to the datum sleeve 9. A rod 5 is then selected in dependence upon the thickness of any thermal insulation and the rod is screwed into the structure until a predetermined depth has been achieved according to the location of the datum sleeve. The energy absorber 11 is then attached to the free end of the rod 5 by way of the rotational assembly 13.

In use of the fall arrest apparatus shown in FIGS. 1 to 6, a fall arrest device (not shown), such as a lanyard, is secured to the attachment point 33, for example by way of a karabiner. In the event of a fall, the rod will first deform by bending. In the case of the left-hand rod of FIG. 1, the rod will bend in the region of point a, in the case of the middle rod of FIG. 1 the rod will bend in the region of point a and/or point b, and in the case of the right-hand rod of FIG. 1, the rod will bend about point a and/or point c. The point(s) of deformation may depend on the rigidity of any insulation 1. Only after the rod 5 has deformed will the energy absorber 11 deploy, initially by deforming and then by the rip zone 41 tearing to absorb energy when subject to a force in excess of a threshold. The fall arrest apparatus must be replaced after a fall has occurred.

Figure 7:
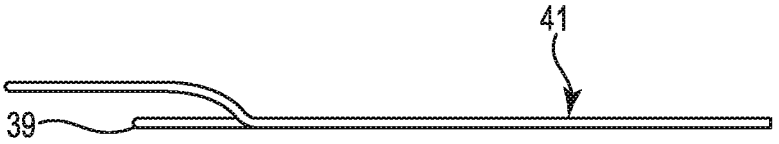
FIG. 7 is a side view of a first alternative embodiment of the energy absorber shown in FIGS. 3 to 5.
Figure 8:
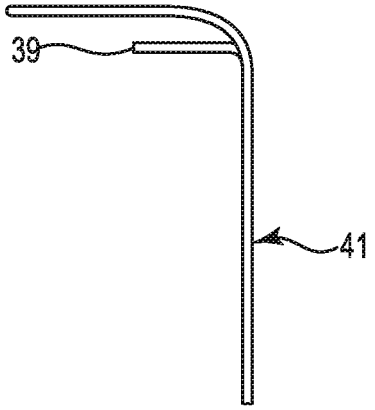
FIG. 8 is a side view of a second alternative embodiment of the energy absorber shown in FIGS. 3 to 5.

FIGS. 7 and 8 show alternative arrangements for the rip zone. In FIG. 7 the rip zone 41 is substantially coplanar with the connection 39, while in FIG. 8 the rip zone 41 is substantially perpendicular to the connection 39. The arrangement of FIG. 8 has a greater resistance to tear than those of FIGS. 3 to 5 and 7, indicating that the properties of the rip zone can be adjusted by straightforward experiments, allowing a configuration to be selected which provides particular characteristics being sought.

Figure 9:
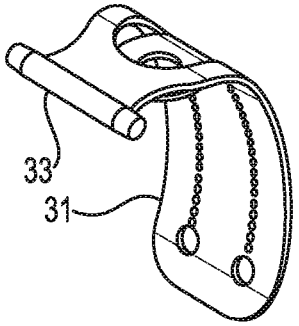
FIG. 9 is a perspective view, corresponding to the view of FIG. 5, of an alternative form of the energy absorber.

The energy absorber shown in FIG. 9 is similar to that shown in FIG. 5 except that the attachment point for further fall arrest means is in the form of a tube 33 which is welded to the end of the plate 31. The energy absorber of FIG. 9 is intended for use as an intermediate anchor in a fall arrest system incorporating a cable, the cable passing through the tube when the system has been installed.

Although the fall arrest system of the present invention has been described above in relation to concrete structures, implying the structure is solid concrete, the system can also be used with hollow core concrete structures. In this case, either a resin fix sleeve can be provided over the lower end of the rod 5, up to the datum point 9, or the lower end of the rod may be mounted in a baseplate (not shown) which may itself be secured to the structure.

The invention claimed is:

1. A fall arrest apparatus comprising:

a rod adapted at a first end region thereof to be attached to a structure; and an energy absorber attached to a second end region of the rod, the energy absorber including a connection portion comprising a connection for attachment to the second end region of the rod, an attachment portion comprising an attachment point adjacent a distal end of the apparatus for attachment of at least one additional fall arrest apparatus, and an energy absorbing portion extending in a generally longitudinal direction from the connection portion and the attachment portion and configured to absorb energy when subject to a force in excess of a threshold, the connection portion and the attachment portion extend in a lateral distal direction relative to the energy absorbing portion and are deformed out of a plane of a remainder of the energy absorber, and the attachment portion is deformed so as to extend substantially parallel to the connection portion in a same lateral direction from the remainder of the energy absorber to provide an offset distance in the longitudinal direction between the attachment portion and the connection portion.

2. A fall arrest apparatus as claimed in claim 1, wherein the energy absorber is secured to the second end region of the rod by way of a rotational assembly which allows the energy absorber to rotate about the axis of the rod.

3. A fall arrest apparatus as claimed in claim 2, wherein the rotational assembly comprises a first nut threaded onto the second end region of the rod, a first washer adjacent to the first nut, a spacer adjacent to the first washer, a second washer adjacent to the spacer and a second nut adjacent to the second washer, the energy absorber being provided with an opening through which the spacer passes.

4. A fall arrest apparatus as claimed in claim 1, wherein the rod is provided as a single length and is provided with a weatherproof covering that stops short of the second end of the rod and is sealed to the rod in the second end region thereof.

5. A fall arrest apparatus as claimed in claim 1, wherein the rod includes an indicator to indicate a depth to which the rod is to be inserted into the structure.

6. A fall arrest apparatus as claimed in claim 5, wherein a washer is provided to be positioned in use between the indicator and the structure, the indicator comprises a datum sleeve, and the datum sleeve is compressed onto the rod.

7. A fall arrest apparatus as claimed in claim 1, wherein the attachment point is configured and arranged for at least one of attaching a karabiner to the energy absorber and allowing a cable to pass through the attachment point.

8. A fall arrest apparatus as claimed in claim 1, wherein the energy absorber is made from a single plate of metal which is formed with the attachment point at one end region thereof, and a slit which defines the periphery of a connection to the rod, ends of the slit leading to the energy absorbing portion.

9. A fall arrest apparatus as claimed in claim 1, wherein the energy absorbing portion is a rip zone including two lines of weakness which, when subject to the force in excess of the threshold, tear longitudinally to absorb energy.

10. A fall arrest apparatus as claimed in claim 9, wherein the two lines of weakness are parallel, the two lines each terminate in a relatively larger discontinuity than a transverse dimension of the line of weakness, the lines of weakness are each in the form of a row of discontinuities, and the discontinuities are selected from holes, recesses and slits extending in the direction of the respective row.

11. A fall arrest apparatus as claimed in claim 10, wherein the relatively larger discontinuity comprises a terminal hole.

12. A fall arrest apparatus as claimed in claim 9, wherein the discontinuities of the first row are offset in the longitudinal direction of the row relative to the discontinuities of the second row.

13. A fall arrest apparatus as claimed in claim 9, wherein the two rows of discontinuities comprise two grooves.

14. A fall arrest apparatus as claimed in claim 1, wherein the energy absorbing portion has a curvature in the longitudinal direction thereof, the curvature extends the length of the energy absorbing portion.

15. A fall arrest apparatus as claimed in claim 1, wherein the energy absorbing portion is in the form of a coil.

16. A fall arrest apparatus as claimed in claim 1, wherein the energy absorbing portion is substantially coplanar with the connection to the rod.

17. A fall arrest apparatus as claimed in claim 1, wherein the energy absorbing portion is substantially perpendicular to the connection of the energy absorber.

* * * * *